US006938373B2

(12) United States Patent
Wong et al.

(10) Patent No.: US 6,938,373 B2
(45) **Date of Patent: *Sep. 6, 2005**

(54) WINDOW SASH POSITION MAINTAINER

(75) Inventors: Lenny Wong, Warroad, MN (US); Leslie B. Hendrickson, Roseau, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/712,773

(22) Filed: Nov. 13, 2003

(65) Prior Publication Data

US 2004/0148863 A1 Aug. 5, 2004

Related U.S. Application Data

(63) Continuation of application No. 09/703,533, filed on Nov. 1, 2000, now Pat. No. 6,672,009, which is a continuation of application No. 09/328,085, filed on Jun. 8, 1999, now Pat. No. 6,141,913.

(51) Int. Cl.[7] ..... E05D 15/22
(52) U.S. Cl. ..... 49/183; 49/181; 49/445
(58) Field of Search ..... 49/183, 181, 182, 49/184, 185, 186, 445, 446, 447, 465; 292/225, DIG. 20

(56) References Cited

U.S. PATENT DOCUMENTS

| | | | | |
|---|---|---|---|---|
| 118,512 | A | 8/1871 | Butler | |
| 1,457,366 | A | 6/1923 | Horner | |
| 2,305,275 | A | 12/1942 | Pyle et al. | |
| 2,561,295 | A | 7/1951 | Stone | 312/333 |
| 2,670,982 | A | 3/1954 | Banham | |
| 2,752,185 | A | 6/1956 | Coppola | |
| 2,932,861 | A | 4/1960 | Kunkel | |
| 2,987,758 | A | 6/1961 | Osten, Sr. | 16/197 |
| 3,010,163 | A | 11/1961 | Osten, Sr. | |
| 3,172,145 | A | 3/1965 | Miller | |
| 3,197,819 | A | 8/1965 | Trout | |
| 3,233,278 | A | 2/1966 | Lundgren | 16/197 |
| 3,248,821 | A | 5/1966 | Johnson | |
| 3,429,071 | A | 2/1969 | Phillips | 49/181 |
| 3,522,675 | A | 8/1970 | Metzger | 49/451 |
| 3,970,343 | A | 7/1976 | Horn | 296/137 |
| 4,290,231 | A | 9/1981 | Blair | 49/173 |
| 4,525,952 | A | 7/1985 | Cunningham et al. | 49/449 |
| 4,955,159 | A | 9/1990 | Rogers | 49/161 |
| 5,406,749 | A | 4/1995 | Goldenberg | 49/178 |
| 5,572,828 | A | 11/1996 | Westfall | 49/181 |
| 5,572,839 | A | 11/1996 | Kinsey | 52/204.51 |
| 5,636,475 | A | 6/1997 | Nidelkoff | 49/178 |
| 5,669,180 | A | 9/1997 | Maier | 49/181 |
| 5,901,499 | A | 5/1999 | Delaske et al. | 49/183 |
| 5,992,907 | A * | 11/1999 | Sheldon et al. | 292/34 |
| 6,141,913 | A | 11/2000 | Wong et al. | 49/465 |
| 6,155,615 | A * | 12/2000 | Schultz | 292/163 |
| 6,330,764 | B1 | 12/2001 | Klosterman | 49/375 |
| 6,679,001 | B1 * | 1/2004 | Guelck | 49/183 |
| 2003/0024168 | A1 * | 2/2003 | Mitchell et al. | 49/449 |
| 2004/0031202 | A1 * | 2/2004 | Maier | 49/181 |
| 2004/0074146 | A1 * | 4/2004 | Eenigenburg | 49/183 |

FOREIGN PATENT DOCUMENTS

| | | | |
|---|---|---|---|
| GB | 2226357 | 6/1990 | E06B/3/42 |

* cited by examiner

*Primary Examiner*—Bruce A. Lev
(74) *Attorney, Agent, or Firm*—Schwegman, Lundberg, Woessner & Kluth, P.A.

(57) ABSTRACT

Structure for maintaining a sliding window sash at an intended position with respect to a frame within which the sash moves. The structure serves to retain the sash at a position along an axis generally perpendicular to a plane defined by the window frame. An inwardly facing surface of the frame has formed therein an elongated trough which extends generally parallel to a direction of intended sliding movement of the sash. A blade is mounted within a cavity in the sash and disposed for pivotal movement between a first position, wherein the blade is retracted within an outwardly facing surface of the sash, and a second position, wherein the blade is extended through the outwardly facing surface of the sash into the trough defined within the inwardly facing surface of the frame. The blade is normally biased to the second position, but it can volitionally be retracted to the first position to enable tilting inward or removal of the sash from the window frame.

20 Claims, 5 Drawing Sheets

WINDOW SASH POSITION MAINTAINER

RELATED APPLICATIONS

This application is a continuation under 37 C.F.R. 1.53(b) of U.S. application Ser. No. 09/703,533 filed Nov. 1, 2000 (now U.S. Pat. No. 6,672,009), which is a continuation of U.S. application Ser. No. 09/328,085 filed Jun. 8, 1999 (now U.S. Pat. No. 6,141,913), the specifications of which are incorporated herein by reference.

TECHNICAL FIELD

The present invention deals broadly with the field of windows. More specifically, however, the invention applies to a window, such as double-hung window, wherein a sash slides within a frame. The specific focus of the invention is structure employed to effect retention of the window sash within the frame at an intended location along an axis perpendicular to a plane defined by the window frame within which the sash slides.

BACKGROUND OF THE INVENTION

The prior art includes many types of windows which are employed to bring light into a building. One type of window known in the prior art is a double-hung window. Such a window typically employs two vertically movable sash assemblies, each carrying its own pane of glass, which are movable, typically, vertically within the frame.

Opposed, inwardly facing lateral portions of the frame are typically provided with a balance tube which includes appropriate structure to render the window sashes more safe. Balance mechanisms are employed within the balance tube in order to deter undesirable, unintended slamming of a sash such that injury could result.

It is also desirable, however, that the sashes be able to be tilted inward or removed for cleaning of the glass portions of the sash assemblies. Various mechanisms have been employed to release a sash from a position which it is intended to occupy within the frame. Typically, a sash is desired to be located at a position along an axis, generally perpendicular to a plane defined by the frame, for sliding movement along that position. Various types of structures have been utilized to effect maintenance of a sash in the desired position yet allow it to be tilted inward or removed for cleaning. One such structure utilizes a pair of laterally extending latch mechanisms carried by the sash. The latch mechanisms move linearly along an axis through the sash and into the frame. One latch mechanism extends laterally on one side of the sash and a second latch mechanism extends laterally on the other side of the sash. When it is desired to remove a sash, the sash is moved to an intended vertical release location, and the person removing the sash releases one latch with one hand and the other latch with the other hand. The sash is then tilted or slid out of its normal position and removed from the frame for cleaning. Such a structure has a number of drawbacks. One is that the person removing the window sash needs full availability of both hands to effect release of the latches. Attempts have been made to solve this problem by designing a unitary assembly for concurrently releasing both latches (that is, for simultaneously effecting retraction of the latches). While some measure of success has been achieved with these attempts, other problems still exist. For example, linearly moving latches typically do not provide fully adequate definition of structure for sliding of a sash along an intended track and adequate resistance to pressures which might tend to dislodge a sash from the window frame. One reason for the inadequate resistance to dislodgement is the relatively small cross-section of a latch mechanism extending from the sash.

It is to these dictates and shortcomings of the prior art that the present invention is directed. It is a position maintenance mechanism which addresses these dictates and problems and provides solutions which make the invention a significant over prior art apparatuses.

SUMMARY OF THE INVENTION

The present invention is apparatus which functions to maintain a sliding window sash at an intended position along an axis which is generally perpendicular to a plane defined by a frame within which the sash slides. The frame has an inwardly facing surface which, when the sash is in an intended position at which it slides within the frame, is Opposite an outwardly facing surface of the sash. The apparatus in order to maintain the sash at such an intended position includes means to define an elongated trough formed in the inwardly facing surface of the frame. The trough extends generally parallel to the plane defined by the frame and generally in the direction of intended sliding of the sash. The apparatus further includes a blade which defines a plane and means to mount the blade within a cavity in the sash. The blade is mounted and oriented with the plane defined thereby generally parallel to the plane defined by the frame. The blade is disposed within the sash for pivotal movement between a first position and a second position. In the first position of the blade, it is retracted within the outwardly facing surface of the sash and does not extend outwardly beyond the surface of the sash. In its second position, the blade is extended beyond the outwardly facing surface of the sash and into the trough. Means are provided to normally bias the blade to the second position thereof, and means are provided to allow selective retraction of the blade to its first position.

It is intended that the blade, when it is in its second position received within the trough, will be extended fully into the trough to engage a bottom thereof. In a preferred embodiment, the bottom of the trough has a slot formed therein. The location of the slot along the bottom of the trough is such that, when the sash is in a closed position, the blade is at a position coextensive with the slot and extends into the slot. The pivotal disposition of the blade wherein it is extended into and through the slot in the bottom of the trough is defined as a third position of the blade.

In the preferred embodiment, the blade includes an edge which is angled such that, as the sash is moved from a closed position to an open position, the angled edge engages an end of the slot and ramps the blade up and out of the slot. Such action facilitates retraction of the blade from its third position to its second position.

The blade is disposed for pivoting about an axis which is generally perpendicular to the plane defined by the window frame. It is envisioned that a coil spring would be employed to bias the blade about such an axis outwardly through, and away from, the outwardly facing surface of the sash to its second and third positions.

The preferred embodiment contemplates employment of a linearly moving actuator to effect retraction of the blade within the outwardly facing surface of the sash. Such an actuator would be operatively connected to the blade to overcome the biasing of the blade to its second and third positions, and would effect rotation of the blade in a direction opposite that in which the coil spring biases the blade.

A preferred embodiment of the invention includes a wire yolk which is attached to the blade and a length of cord which is attached to the yolk. The cord extends away from the yolk and is attached to a driver for drawing the length of cord inwardly with respect to the outwardly facing surface of the sash to effect rotation of the blade against the biasing means.

It is envisioned that an end plate assembly would be provided for cooperation with the sash, the end plate assembly including a face plate mounted generally flush with the outwardly facing surface. The end plate assembly would include a pair of generally parallel tabs extending inwardly from the face plate. The tabs, it is intended, would have oppositely facing surfaces, each of these surfaces mounting a stub axle which is substantially coaxial with a stub axle on the facing surface of the other tab. The two-stub axles would extend toward each other so as to be received within an aperture in the blade, the aperture sized and shaped to receive the stub axles.

Each of opposite sides of the blade defines a ramp surface. When the blade is inserted between distal ends of the stub axles, the ramp surfaces increasingly urge the distal ends of the stub axles apart until the distal ends become registered with the aperture. They then snap into the aperture to effect mounting of the blade.

In practice, a sash configured in accordance with the invention would very likely employ means defining an elongated trough in each of oppositely facing inward surfaces of the frame. Each of said troughs would extend generally parallel to the plane defined by the frame and generally in a direction of intended sliding of the sash. Each of such troughs would be intended to receive one of a pair of blades which define a generally common plane. Each of the pair of blades would be mounted within a corresponding cavity in the sash and oriented with the plane defined by the blades generally parallel to the plane defined by the frame. As in the case of the structure previously described, each blade would be disposed for pivotal movement between a first position, wherein the blade is retracted within a corresponding outwardly facing surface of the sash, and a second position, wherein each of the blades is extended into a corresponding trough in an inwardly facing surface of the frame which is opposite the outwardly facing surface of the sash within which the cavity in which the blade is mounted is formed. The blades would normally be biased to their second positions in engagement with the bottom of the troughs, and means for selectively retracting the blades to their first positions would be provided.

With the dual blade embodiment, means would be provided to effect retraction of the blades from their second positions to their first positions simultaneously. The invention envisions a common member for effecting concurrent retraction of the blades.

The present invention is thus improved apparatus for mounting and maintaining a sash within a window frame. More specific features and advantages obtained in view of those features will become apparent with reference to the accompanying drawing figures, the DETAILED DESCRIPTION OF THE INVENTION, and appended claims.

DETAILED DESCRIPTION OF THE INVENTION

Figure 1:
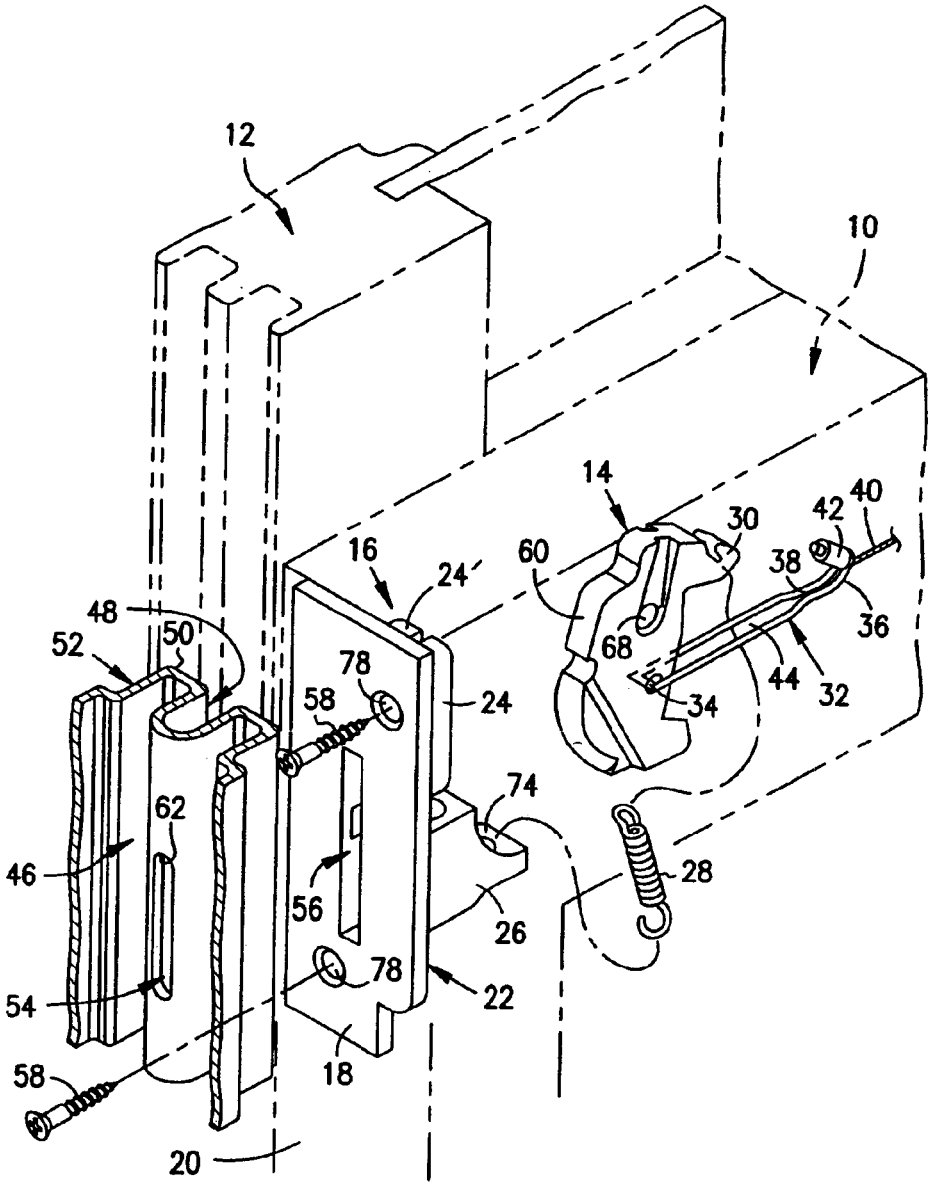
FIG. 1 is a perspective, exploded view of apparatus in accordance with the present invention, window sashes being shown in phantom, and some portions of the structure being broken away.

Referring now to the drawings, wherein like reference numerals denote like elements throughout the several views, FIG. 1 is an exploded view illustrating dual sashes 10, 12 of a double hung window and a blade mechanism 14, which is intended to be recessed within a cavity 16 in the inner sash 10. The cavity 16 in the sash 10 is overlain, on a side of the sash, by a face plate 18 mounted generally flush with the outwardly facing side surface 20 of the sash 10. The face plate 18 is part of an end plate assembly 22 which includes, additionally, a pair of generally parallel tabs 24, 24' which extend inwardly from the face plate 18 into the cavity 16. The end plate assembly 22 also includes a base 26 which functions for an intended purpose as will be discussed hereinafter.

The figures illustrate a blade member 14 which is pivotally mounted for rotation about an axis generally transverse to a plane defined by the window sash 10. FIGS. 2–7 illustrate the specific structure of the end plate assembly 22 and its cooperation in mounting the blade 14 for rotation.

FIG. 1 illustrates a coil spring 28 which is shown as being connectable, at one end thereof, to a hook member 30 of the blade 14. The other end of the coil spring 28 is connectable to the base 26 of the end plate assembly 22. The coil spring 28, thereby, biases the blade 14 for rotation, in a direction as seen in FIG. 1, in a clockwise direction.

A yoke member 32 is attached to the blade 14 to effect selective overcoming of the bias of the coil spring 28 in order to retract the blade 14 for a purpose discussed hereinafter. The yoke member is illustrated as being constructed of a wire stock formed into a bail, opposite ends of which are passed through an aperture 34 provided in the blade 14. The bail 32 thereby has an end, proximate the blade 14, which serves to apply force to the blade 14 in a direction, as viewed in FIG. 1, counter clockwise so as to overcome the bias of the coil spring 28. The wire from which the bail 32 is formed is provided with a narrow neck 36 at an end remote from blade 14. The neck 36 defines a channel 38 which extends away from the blade 14, when the bail 32 is connected to the blade 14, to facilitate connection of an actuator mechanism (not shown). A remote end of the actuator is illustrated in FIG. 1. A segment of flexible filament 40 is shown as extending through the narrowed channel 38 formed in the neck 36, an end of the filament 40 having a sleeve 42 crimped onto the filament 40. Typically, the sleeve 42 would have a diameter smaller than an expanded channel 44 formed within the bail 32 so that the filament 40 end, with the sleeve 42 crimped thereon, could be slid through the expanded channel 44 and then withdrawn into the narrowed channel 38 which would have a width smaller than the diameter of the sleeve 42.

The overall actuator structure could be constructed in any manner desirable. The actuator would permit volitional rotation of the blade 14 in the counter clockwise direction, as viewed in FIG. 1. With the embodiment illustrated, it would include means for drawing the filament 40 which in turn would draw the yoke 32 to effect the counter clockwise rotation. It will be understood that any appropriate actuator means, however, could suffice.

FIG. 1 also illustrates a portion of a balance tube 46 which defines an elongated trough or track 48 in an inwardly facing surface 50 of the window frame 52. In double hung window applications, the balance tube 46 employs mechanisms which function to deter undesirable, unintended slamming of a sash where injury could result.

The balance tube 46, in the case of the present invention, includes, defined therein, an elongated trough 48 which faces inwardly. The trough 48 extends generally parallel to a plane defined by the window frame 52. The trough 48 runs generally in a direction of intended sliding of the sash 10.

FIG. 1 illustrates a slot 54 formed in the balance tube 46 at the bottom of the trough 48. This slot 54 is formed at a location such that, when the window sash mechanisms are in their closed positions, a corresponding slot 56 in the end plate assembly face plate 18, through which the blade member 14 can extend, is registered with the slot 54 formed in the balance tube trough 48.

In order to ensure that the slot 56 in the face plate 18 is maintained in the desired position relative to the inner sash 10, it is secured at a location on the side stile overlying the cavity 16. Such affixation is typically effected using wood screws 58 as shown.

Figure 2:
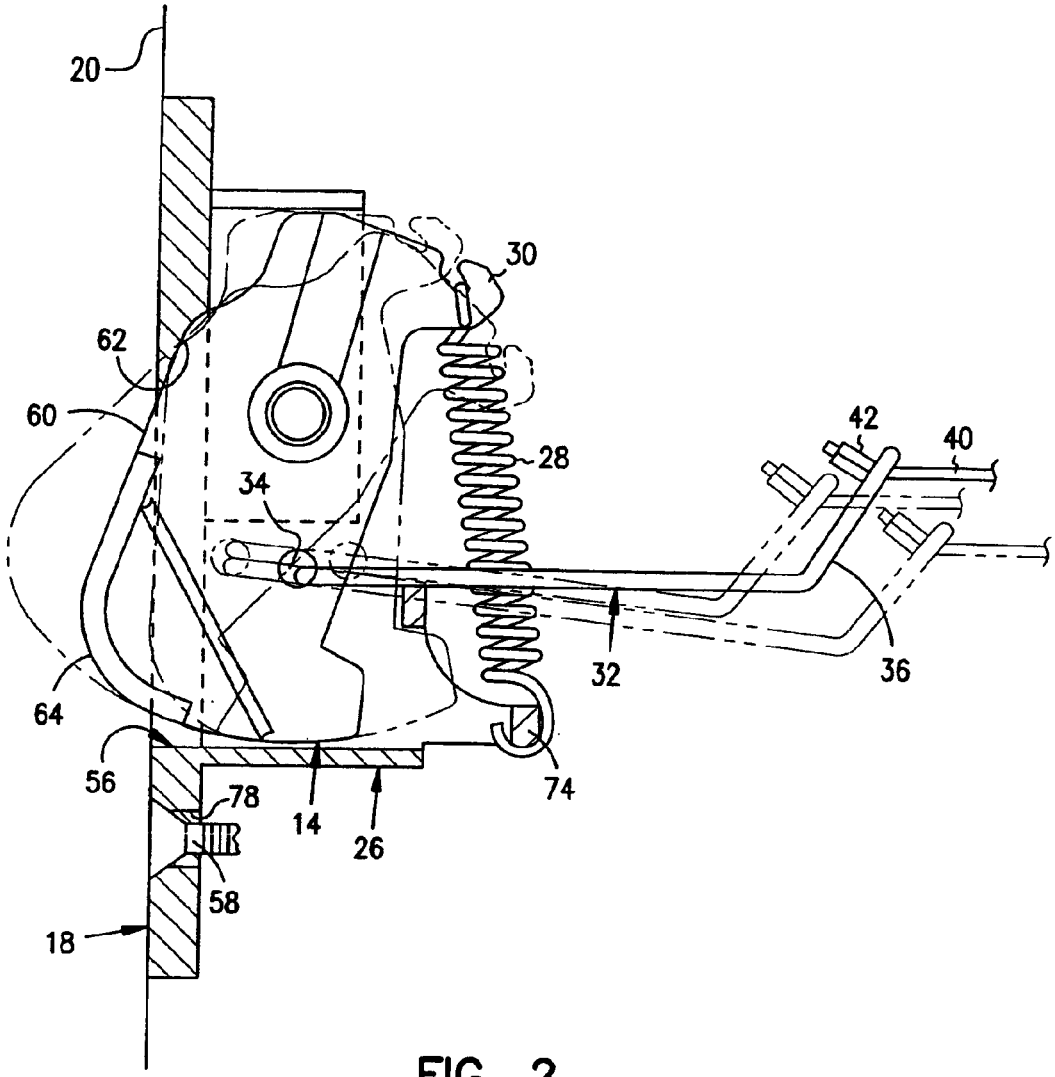
FIG. 2 is a side elevational view of a maintaining blade as mounted within an end plate assembly.

FIG. 2 illustrates the blade 14 mounted in place between the tabs 24, 24' extending inwardly into the cavity 16 from the face plate 18. That figure shows a second position of the blade 14 in solid line and first and third positions of the blade 14 in phantom line.

The first position of the blade 14 is such that the blade 14 is retracted within an outwardly facing surface 20 of the sash 10 (that is, recessed within the cavity 16). The third position of the blade 14 is one wherein the blade 14 not only extends into the trough 48 engaging the bottom thereof, as it does in its second position, but wherein the blade 14 extends fully to the bottom of the trough 48 and into and through the slot 54 formed in the bottom of the trough 48.

As will be able to be seen, when the blade member 14 is in its second position, it will ride in the trough 48 and facilitate raising and lowering of the window sash 10. It serves as a track rider which rides on the track defined by trough 48, and the thickness of the blade member 14 can be made so that there is a minimum, if any, wobble of the sash 10 relative to the window frame 52 of which balance tube 46 is a part. Because of the biasing of the blade 14 to the second position by the coil spring 28, the blade 14 will tend to remain received within the trough 48 as long as action is not taken to operate the actuator in order to overcome the bias of the spring 28 and cause rotation of the blade 14 to its first position.

The bias of the spring 28 is sufficiently strong such that, when the sash 10 is moved to its closed position with the slots in the face plate 56 and bottom of the trough 54 registered, the blade 14 will extend into the slot in the trough 54. This will effect an even more positive preclusion of movement of the sash 10 in a direction perpendicular to a plane defined by the window frame 52. The sash 10 will, thereby, be even more securely disposed to deter unwanted removal.

As the sash 10 is moved along the track, a ramped edge 60 of the blade 14 will ride over a correspondingly ramped surface 62 of an end of the slot 54 in the bottom of the trough 48. This will serve to allow the blade 14 to ride up and out of the slot 54 in the trough 48. Nevertheless, because of the coil spring biasing means 28, the tip 64 of the blade 14 will still engage the bottom of the trough 48.

As will be able to be seen then, unless some positive action is taken to move the blade 14 in a rotational manner to its first position, the blade 14 will be maintained in either its second or third positions. When it is desired, however, to remove the sash 10 from the window, operation of the actuator means can be initiated to overcome the bias of the coil spring 28 and rotate the blade 14 to its first position. With the blade 14 in this position, there will be no obstruction to rotation of the sash 10 out of its location between the frame 52 or, if desired, removal of the sash 10.

Figure 3:
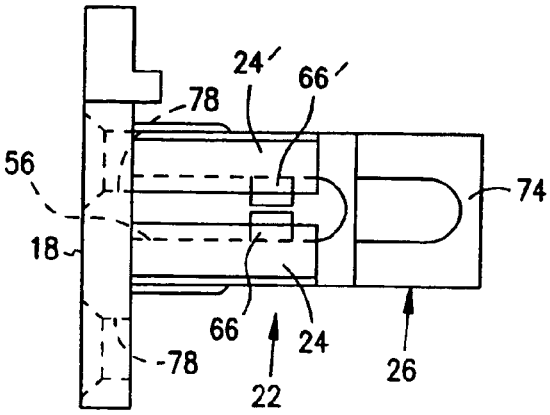
FIG. 3 is a top plan view of the end plate assembly without a blade and biasing spring mounted therewithin.
Figure 5:
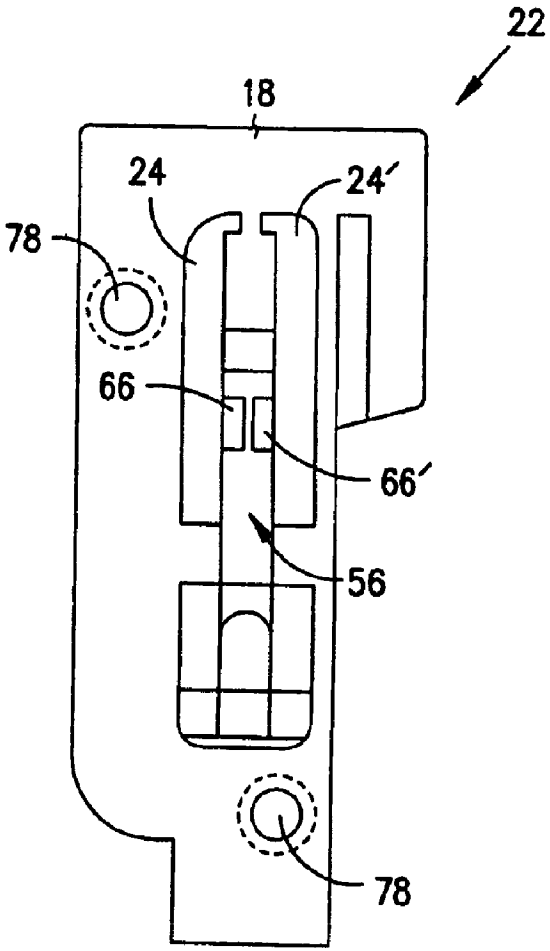
FIG. 5 is a second end view of the face plate assembly of FIG. 3.
Figure 4:
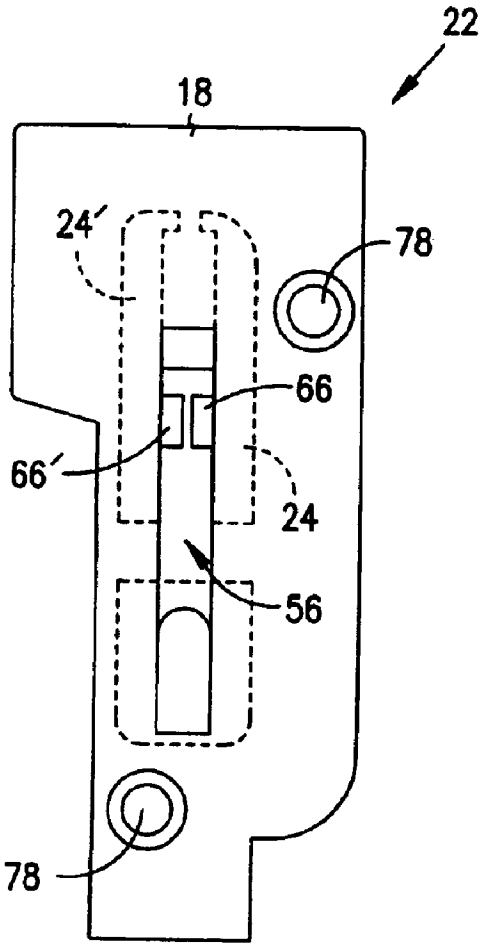
FIG. 4 is a first end view of the face plate assembly of FIG. 3.
Figure 7:
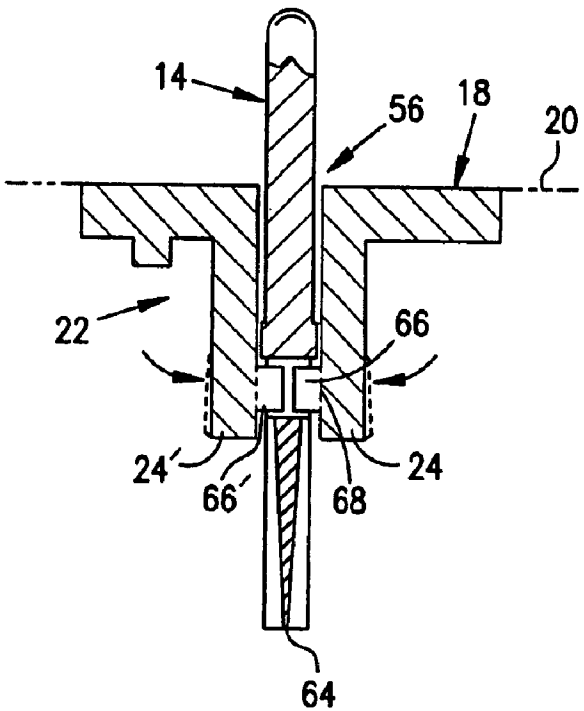
FIGS. 6 and 7 are bottom sectional views illustrating the mounting of a blade in an end plate assembly.
Figure 6:
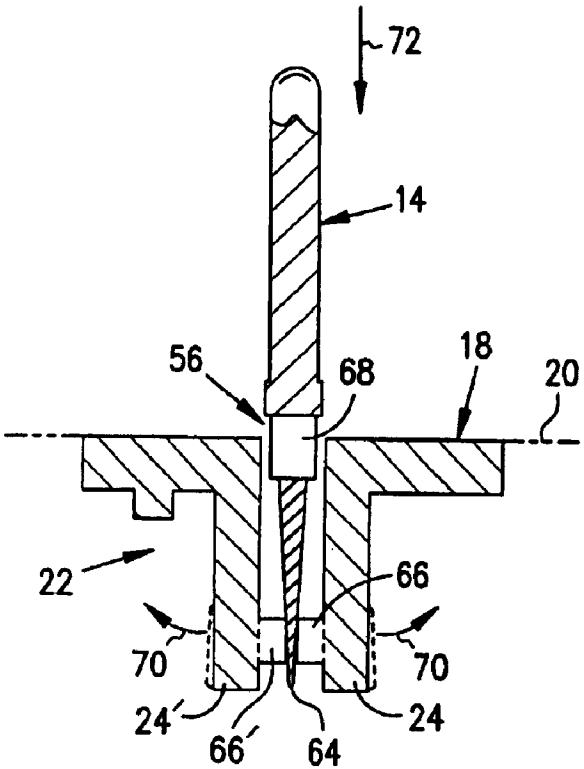
Figure 8:
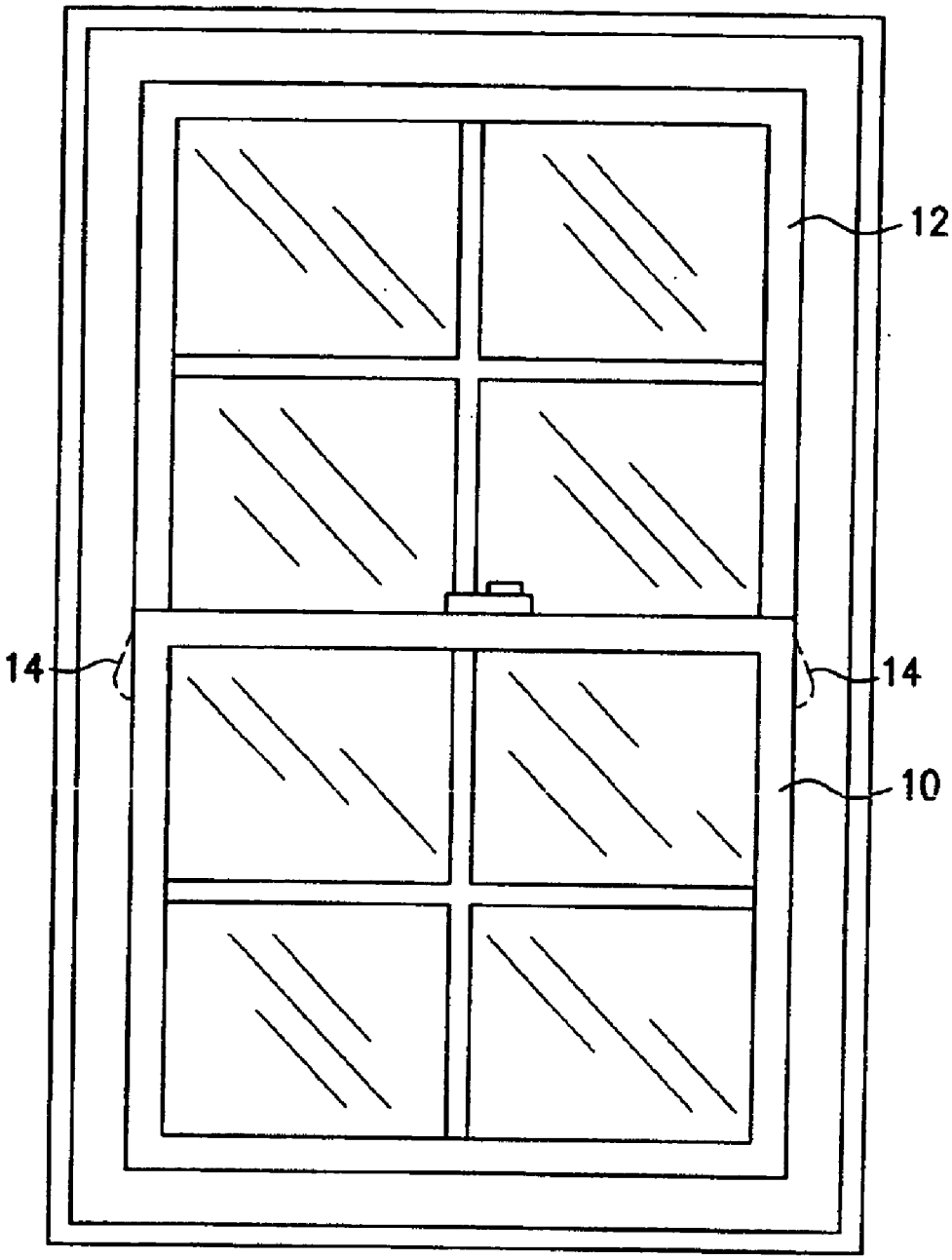
FIG. 8 is an elevational view of a double hung window system.

FIGS. 3–5 illustrate the end plate assembly 22 in different views, and FIGS. 6 and 7 illustrate the assembly 22 in combination with the blade 14. FIG. 6 shows the blade in the process of being inserted into position pivotally mounted to tabs 24, 24' of end plate assembly 22. FIG. 7 shows the blade 14 having been fully inserted between tabs 24, 24' with a stub axle 66, 66' carried by each of tabs 24, 24' snapped into an aperture 68 formed in blade 14. Aperture 68 defines the axis of rotation of blade 14.

Referring now to FIGS. 3–5, end plate assembly 22 includes face plate 18 and tabs 24, 24' extending rearwardly therefrom. As previously discussed, tabs 24, 24' are spaced from each other, and each tab 24, 24' has a stub axle 66, 66' extending inwardly from its corresponding tab 24, 24' toward the other stub axle. The stub axles 66, 66', together, define a shaft about which the blade 14 rotates.

Tabs 24, 24' are manufactured from a resilient material so that they can be deflected outwardly, as indicated by arrows 70 in FIG. 6, to allow introduction of blade 14 therebetween. Blade 14 includes a dual-ramped portion knife edge which serves to urge tabs 24, 24' apart as the ramped surfaces of the knife edge engage inwardly-facing surfaces of the stub axles 66, 66'. Tabs 24, 24' will continue to be urged apart as the knife edge is pushed in the direction of arrow 72 as seen in FIG. 6. Eventually, blade 14 achieves a position as seen in FIG. 7, and tabs 24, 24' snap inwardly to position stub axles 66, 66' within pivot aperture 68 in blade 14. Blade 14 is then mounted for rotation.

FIGS. 1 and 2 illustrate a base 26, as previously discussed, of end plate assembly 22. Base 26 includes a rectangular cross-section shaft which is generally parallel to face plate 18. This rectangular cross-section shaft 74 serves as a point of affixation of one end of coil spring 28. The other end of coil spring 28 is extended upwardly, through an expanded portion of yoke/bail 32, and is attached to blade 14 at hook member 30. As can best be seen in FIG. 2, this will effect a clockwise bias on blade 14 in contra-rotation to the force applied to blade 14 by filament 40 extending from the actuator.

FIGS. 1 and 2 illustrate end plate assembly 22 as being mounted to inner sash 10 with face plate 18 overlying cavity 16. Affixation of end plate assembly 22 to sash 10 is shown as being accomplished with a pair of Phillips-head screws 58. Screws 58 are inserted through aperture 78 in face plate 18 and into sash 10.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. Apparatus for maintaining a sliding window sash at an intended position along an axis perpendicular to a plane defined by a frame within which the sash slides, said frame having an inwardly facing surface which, when the sash is in the intended position, is opposite an outwardly facing surface of the sash, comprising:

(a) means for defining an elongate trough, the elongate trough adapted to be disposed in a portion of the frame, said trough adapted to extend generally parallel to the plane defined by the frame and generally in a direction of intended sliding of the sash;

(b) a blade defining a blade plane;

(c) blade mounting structure adapted to mount the blade within a cavity in the sash said blade adapted to be disposed generally parallel to the plane defined by the frame, said blade disposed for pivotal movement between a first position, wherein said blade is adapted to be retracted within the outwardly facing surface of the sash, and a second position, wherein said blade is extended into said trough;

(d) means for normally biasing said blade to said second position thereof; and (e) means for selectively retracting said blade to said first position thereof.

2. Apparatus in accordance with claim 1 wherein said blade, when in said second position thereof, is extended fully into said trough to engage a bottom thereof.

3. Apparatus in accordance with claim 2 wherein said bottom of said trough has a slot formed therethrough at a location such that, when the sash is in a closed position, said blade is adjacent said slot.

4. Apparatus in accordance with claim 3, wherein said blade is further disposed and biased for pivotal movement to a third position extending into and through said slot.

5. Apparatus in accordance with claim 4 wherein said blade includes an edge angled such that, as the sash is moved from a closed position to an open position, the angled edge engages an end of said slot and facilitates retraction of said blade from said third position thereof to said second position thereof.

6. Apparatus in accordance with claim 1 wherein said blade pivots about an axis, said means for biasing comprising a spring rotatably urging said blade about said axis outwardly through and away from said outwardly facing surface of the sash.

7. Apparatus in accordance with claim 6 wherein said means for retracting comprises a linearly moving actuator operatively connected to said blade to overcome, as said actuator is moved, said means for biasing and rotating said blade in a direction opposite that in which said spring rotably urges said blade.

8. Apparatus in accordance with claim 7 wherein said linearly moving actuator includes a wire yoke attached to said blade, a length of cord attached to said yoke and extending away therefrom, and driving means for drawing said length of cord inwardly with respect to said outwardly facing surface of said sash to rotate said blade against said means for biasing.

9. Apparatus in accordance with claim 1 further comprising an end plate assembly including a face plate adapted to be mounted generally flush with the outwardly facing surface of the sash and a pair of generally parallel tabs extending inwardly from said face plate, said tabs having facing surfaces, each facing surface mounting a stub axle, substantially coaxial with a stub axle on the facing surface of the other tab, extending toward the tab opposite the tab to which the stub axle is mounted, and wherein said blade has, formed therethrough, an aperture shaped and sized to receive therein said stub axles, each of opposite sides of said blade having defined therein a ramp surface positioned such that said blade can be inserted between distal ends of said stub axles and urged increasingly inwardly between said distal ends so that said ramp surfaces urge said distal ends apart until said distal ends become registered with said aperture.

10. The apparatus in accordance with claim 1, wherein said means for defining said elgongate trough includes a recess portion formed in a balance tube assembly.

11. The apparatus in accordance with claim 10, wherein the balance tube assembly further includes at least one slot formed within the recessed portion.

12. The apparatus in accordance with claim 1, further comprising at least one flexible element coupled with at least one blade.

13. The apparatus in accordance with claim 1, wherein the means for selectively retracting said blade is coupled to the blades at a first location, the blades pivotally moveable about a second location, and the first location is offset from the second location.

14. Apparatus for maintaining a sliding window sash at an intended position along an axis perpendicular to a plane defined by a frame within which the sash slides, said frame having, when the sash is in the intended position, opposed inwardly facing surfaces opposite corresponding outwardly facing surfaces of the sash, comprising:

(a) means for defining an elongate trough adapted to be disposed in each inwardly facing surface of the frame, each of said troughs adapted to extend generally parallel to the plane defined by the frame and generally in a direction of intended sliding of the sash;

(b) a pair of blades defining a generally common plane;

(c) means for mounting each of said blades adapted to be disposed within a corresponding cavity in the sash oriented with the generally common plane adapted to be disposed generally parallel to the plane defined by the frame, each of said blades being disposed for pivotal movement between a first position, wherein the blade is adapted to be retracted within a corresponding outwardly facing surface of the sash, and a second position, wherein each of said blades is extended into a corresponding trough;

(d) means for normally biasing said blades to said second positions thereof; and (e) means for selectively retracting said blades to said first positions thereof.

15. Apparatus in accordance with claim 14 wherein said means for retracting includes means for simultaneously moving said blades from said second positions thereof to said first positions thereof.

16. Apparatus in accordance with claim 15 wherein said means for simultaneously moving said blades comprises a unitary assembly for concurrently retracting said blades.

17. The apparatus in accordance with claim 14, wherein said means for defining said elongate trough includes a recessed portion formed in a balance tube assembly.

18. The apparatus in accordance with claim 17, wherein the balance tube assembly further includes at least one slot formed within the recessed portion.

19. The apparatus in accordance with claim 14, further comprising at least one flexible element coupled with at least one blade.

20. The apparatus in accordance with claim 14, wherein said blades have a non-uniform thickness.

* * * * *

UNITED STATES PATENT AND TRADEMARK OFFICE

CERTIFICATE OF CORRECTION

PATENT NO. : 6,938,373 B2
DATED : September 6, 2005
INVENTOR(S) : Wong et al.

It is certified that error appears in the above-identified patent and that said Letters Patent is hereby corrected as shown below:

Title page,
Item [73], Assignee, after "Company," insert -- d/b/a Marvin Windows and Doors --.

Column 8,
Line 8, delete "elgongate" and insert -- elongate --, therefor.

Signed and Sealed this

Twenty-ninth Day of November, 2005

JON W. DUDAS
*Director of the United States Patent and Trademark Office*